US011482357B2

(12) United States Patent
Kawaguchi et al.

(10) Patent No.: US 11,482,357 B2
(45) Date of Patent: Oct. 25, 2022

(54) COIL COMPONENT AND METHOD OF MANUFACTURING THE SAME

(71) Applicant: TDK CORPORATION, Tokyo (JP)

(72) Inventors: Yuuichi Kawaguchi, Tokyo (JP); Masanori Suzuki, Tokyo (JP); Naoaki Fujii, Tokyo (JP); Tomonaga Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 560 days.

(21) Appl. No.: 16/392,886

(22) Filed: Apr. 24, 2019

(65) Prior Publication Data

US 2019/0326041 A1 Oct. 24, 2019

(30) Foreign Application Priority Data

Apr. 24, 2018 (JP) ..... JP2018-082868

(51) Int. Cl.

| | |
|---|---|
| ***H01F 27/28*** | (2006.01) |
| ***H01F 5/04*** | (2006.01) |
| ***H01F 41/04*** | (2006.01) |
| ***H01F 1/06*** | (2006.01) |
| ***H01F 5/06*** | (2006.01) |

(52) U.S. Cl.

CPC ..... *H01F 5/04* (2013.01); *H01F 1/06* (2013.01); *H01F 5/06* (2013.01); *H01F 41/04* (2013.01)

(58) Field of Classification Search

USPC ..... 336/192, 200, 232, 198

See application file for complete search history.

(56) References Cited

U.S. PATENT DOCUMENTS

| | | | | |
|---|---|---|---|---|
| 10,340,072 | B2 * | 7/2019 | Kitajima | H01F 41/0206 |
| 2007/0205856 | A1 * | 9/2007 | Matsunaga | H01F 17/0013 336/200 |
| 2009/0128275 | A1 * | 5/2009 | Yagasaki | H01F 17/04 336/83 |
| 2009/0251272 | A1 * | 10/2009 | Satake | H01F 17/04 336/221 |
| 2012/0286917 | A1 * | 11/2012 | Uchida | H01F 41/041 336/200 |
| 2013/0027163 | A1 * | 1/2013 | Kosaka | H01F 27/327 336/90 |
| 2013/0222101 | A1 * | 8/2013 | Ito | H01F 3/08 336/83 |
| 2014/0002221 | A1 * | 1/2014 | Shin | H01F 1/33 336/83 |
| 2015/0097647 | A1 * | 4/2015 | Lee | H01F 17/0013 336/192 |

(Continued)

FOREIGN PATENT DOCUMENTS

| | | |
|---|---|---|
| JP | 2013225718 A | 10/2013 |
| JP | 2017-76735 A | 4/2017 |

*Primary Examiner* — Shawki S Ismail
*Assistant Examiner* — Kazi S Hossain
(74) *Attorney, Agent, or Firm* — Young Law Firm, P.C.

(57) ABSTRACT

Disclosed herein is a coil component that includes: a magnetic element body containing magnetic powder, the magnetic element body having first and second surfaces; a coil conductor embedded in the magnetic element body; and an external terminal connected to the coil conductor and exposed on the first surface of the magnetic element body. The second surface of the magnetic element body is free from the external terminal. The first surface is greater in surface roughness than the second surface.

10 Claims, 8 Drawing Sheets

(56) References Cited

U.S. PATENT DOCUMENTS

| | | | | |
|---|---|---|---|---|
| 2016/0012961 | A1 | 1/2016 | Suzuki et al. | |
| 2016/0260535 | A1* | 9/2016 | Kubota | H01F 17/0013 |
| 2016/0276089 | A1* | 9/2016 | Inoue | H01F 17/0033 |
| 2016/0351314 | A1* | 12/2016 | Jeong | H01F 17/0013 |
| 2017/0053732 | A1* | 2/2017 | Moon | H01F 27/292 |
| 2018/0061550 | A1* | 3/2018 | Lee | H01F 17/0013 |
| 2018/0061551 | A1* | 3/2018 | Kondou | H01F 27/29 |
| 2018/0130587 | A1* | 5/2018 | Tanaka | H01L 28/10 |

* cited by examiner

COIL COMPONENT AND METHOD OF MANUFACTURING THE SAME

BACKGROUND OF THE INVENTION

Field of the Invention

The present invention relates to a coil component and its manufacturing method and, more particularly, to a coil component having a structure in which a coil conductor is embedded in a magnetic element body containing magnetic powder and its manufacturing method.

Description of Related Art

A common surface-mount type coil component has a configuration in which a coil conductor is formed on the surface of a non-magnetic resin layer. In order to enhance inductance, the coil conductor may be embedded in a magnetic material. For example, JP 2013-225718 A discloses a coil component having a configuration in which a resin substrate on which a coil conductor is formed is embedded in magnetic resin. The magnetic resin is a mixture of metal magnetic powder and a resin material and has high permeability and thus functions as a magnetic path for magnetic flux generated from the coil conductor.

However, in the coil component described in JP 2013-225718 A, an external terminal is formed over the side surface of a chip and main surface thereof perpendicular to a coil axis, so that magnetic flux is partially blocked by the external terminal, which may result in reduction in inductance. To prevent this, the external terminal may be formed only on the chip side surface; however, even in this case, when the coil component is mounted on a circuit board, solder may sneak along the surface of the magnetic resin, with the result that an unintended portion may be covered with the solder.

SUMMARY

It is therefore an object of the present invention to provide a coil component capable of preventing sneaking of solder at mounting and its manufacturing method.

A coil component according to the present invention includes a magnetic element body containing magnetic powder, a coil conductor embedded in the magnetic element body, and an external terminal connected to the coil conductor and exposed on a first surface of the magnetic element body. The magnetic element body further includes a second surface on which the external terminal is not exposed. The surface roughness of the first surface is larger than the surface roughness of the second surface.

According to the present invention, the surface roughness of the first surface of the magnetic element body is large, so that the creeping distance of the first surface is increased. This makes it difficult for solder to sneak along the first surface at mounting, preventing the solder from covering an unintended portion of the magnetic element body.

In the present invention, the magnetic element body may have a substantially rectangular parallelepiped shape. The first and second surfaces may be perpendicular to each other. The magnetic element body may further include a third surface positioned on the side opposite to the first surface, a fourth surface positioned on the side opposite to the second surface, and fifth and sixth surfaces which are perpendicular to the first to fourth surfaces and positioned on mutually opposite sides. The external terminal may include a first external terminal connected to one end of the coil conductor and a second external terminal connected to the other end of the coil conductor. The first external terminal may be exposed on the first and fifth surfaces without being exposed on the second, third, fourth, and sixth surfaces. The second external terminal may be exposed on the first and sixth surfaces without being exposed on the second, third, fourth, and fifth surfaces. With this configuration, the first and second external terminals are each formed over the two surfaces, so that when the coil component is mounted on a circuit board by soldering, a fillet of the solder can be formed.

In the present invention, the dimension of each of the first and second terminal electrodes in a direction perpendicular to the second and fourth surfaces may be smaller than the dimension of the magnetic element body in the same direction. This makes it difficult for the solder formed in the first and second external terminals to sneak to the second and fourth surfaces.

In the present invention, the coil axis of the coil conductor may be perpendicular to the second and fourth surfaces. This prevents magnetic flux passing through the second and fourth surfaces from being blocked by the solder sneaking to the second and fourth surfaces.

In the present invention, the magnetic powder is made of a metal magnetic material whose surface is insulation-coated. This prevents the metal magnetic material from being exposed even when the surface of the magnetic powder is exposed from the magnetic element body.

In the present invention, the coil conductor may be made of copper (Cu), and the external terminal may contain nickel (Ni) and tin (Su). This can enhance solder wettability.

A coil component manufacturing method according to the present invention includes the steps of embedding a coil conductor in a magnetic element body containing magnetic powder, dicing the magnetic element body so as to expose the end portion of the coil conductor, and etching a magnetic body exposed on the dicing surface of the magnetic element body.

According to the present invention, the magnetic body exposed on the dicing surface of the magnetic element body is removed, making it possible to increase the surface roughness of the dicing surface of the magnetic element body.

The coil component manufacturing method according to the present invention may further include a step of plating the end portion of the coil conductor exposed on the dicing surface after etching of the magnetic body. Thus, the plating is performed after removal of the magnetic body exposed on the dicing surface, preventing plating from being formed on the surface of the magnetic body.

As describe above, according to the present invention, in the coil component using the magnetic element body containing the magnetic powder, it is possible to prevent sneaking of solder at mounting.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
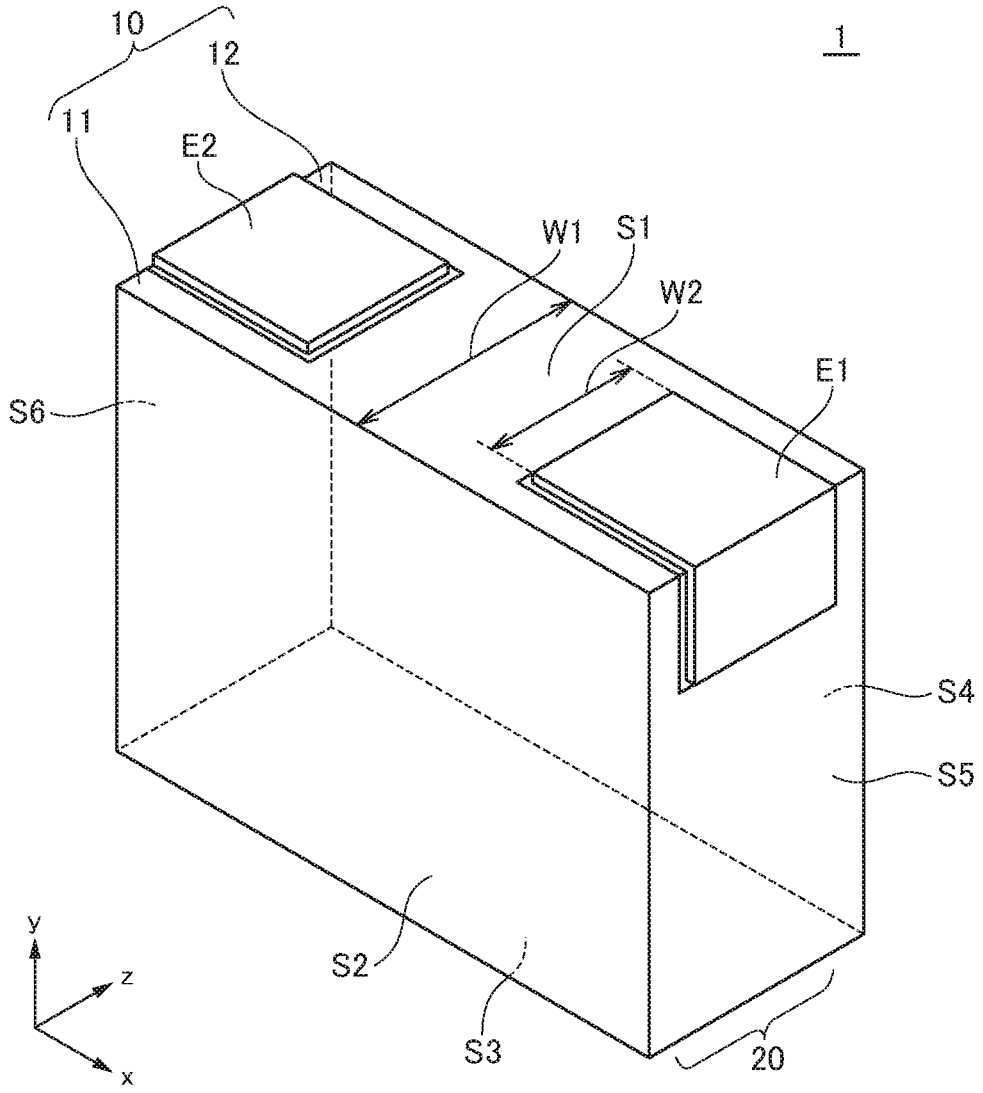
FIG. 1 is a schematic perspective view illustrating the outer appearance of a coil component according to a preferred embodiment of the present invention.

FIG. 1 is a schematic perspective view illustrating the outer appearance of a coil component 1 according to a preferred embodiment of the present invention.

The coil component 1 according to the present embodiment is a surface-mount type chip component suitably used as an inductor for a power supply circuit and includes a magnetic element body 10 constituted of first and second magnetic material layers 11 and 12 and a coil part 20 sandwiched between the magnetic material layers 11 and 12, as illustrated in FIG. 1. In the present embodiment, the coil part 20 has a configuration in which four conductive layers each having a coil conductive pattern are laminated to form one coil conductor. One end of the coil conductor is connected to a first external terminal E1, and the other end thereof is connected to a second external terminal E2.

Detailed configuration of the coil part 20 will be described later.

The magnetic element body 10 constituted of the magnetic material layers 11 and 12 is a composite member formed from resin containing metal magnetic powder made of iron (Fe) or a permalloy-based material and constitutes a magnetic path for magnetic flux which is generated when current is made to flow in the coil. As the resin, epoxy resin of liquid or powder is preferably used.

Unlike a common laminated coil component, the coil component 1 according to the present embodiment is vertically mounted such that the z-direction that is the lamination direction is parallel to a circuit board. Specifically, a surface S1 of the magnetic element body 10 that constitutes the xz plane is used as a mounting surface. On the mounting surface S1, the first and second external terminals E1 and E2 are provided. The first external terminal E1 is connected with one end of the coil conductor formed in the coil part 20, and the second external terminal E2 is connected with the other end of the coil conductor formed in the coil part 20.

As illustrated in FIG. 1, the first external terminal E1 is continuously formed from the surface S1 to a surface S5 constituting the yz plane, and the second external terminal E2 is continuously formed from the surface S1 to a side surface S6 constituting the yz plane. Although details will be described later, the external terminals E1 and E2 are each constituted of a laminated film of nickel (Ni) and tin (Sn) formed on the exposed surface of an electrode pattern included in the coil part 20. The external terminals E1 and E2 are not formed on the other surfaces of the magnetic element body 10, i.e., surfaces S2 and S4 constituting the xy plane and the surface S3 constituting the xz plane.

A dimension W2 of the external terminals E1 and E2 in the z-direction is smaller than a dimension W1 of the magnetic element body 10 in the z-direction. Thus, the surfaces S1 and S5 or S6 of the magnetic element body 10 are exposed on both sides of the external terminal E1 or E2 in the z-direction.

Figure 2:
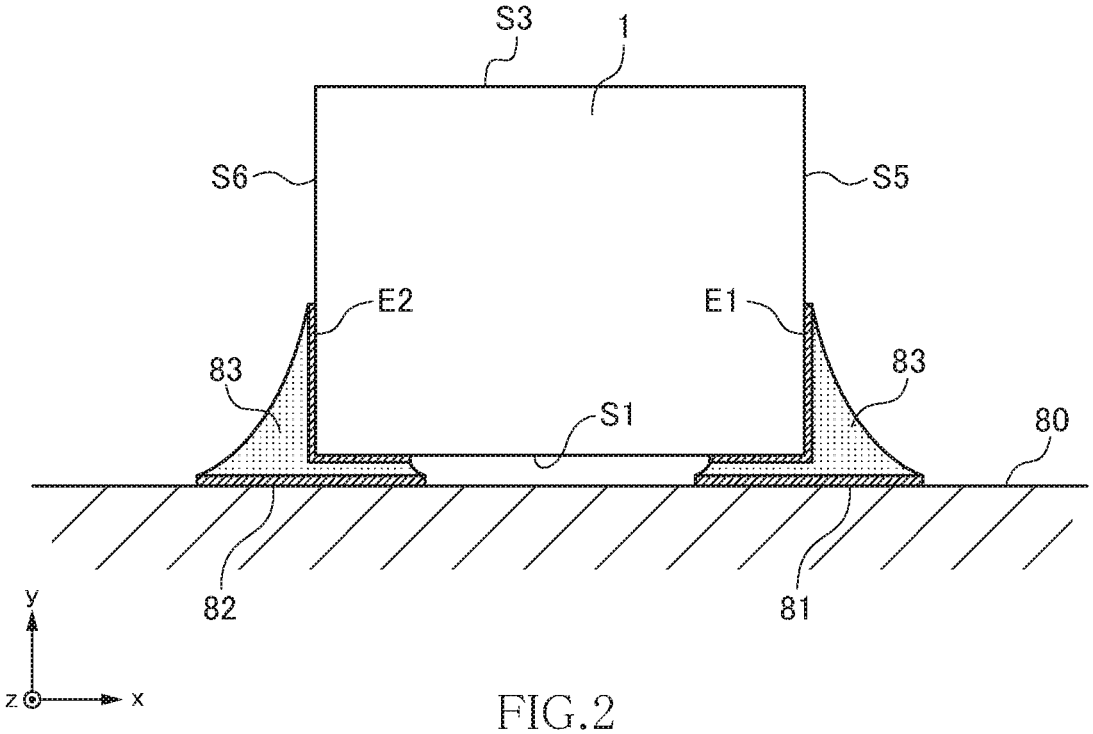
FIG. 2 is a side view illustrating a state where the coil component according to an embodiment of the present invention is mounted on a circuit board as viewed in the lamination direction.

FIG. 2 is a side view illustrating a state where the coil component 1 according to the present embodiment is mounted on a circuit board 80 as viewed in the lamination direction.

As illustrated in FIG. 2, the coil component 1 according to the present embodiment is mounted vertically on the circuit board 80. Specifically, the coil component is mounted such that the surface S1 of the magnetic element body 10 faces the mounting surface of the circuit board 80. That is, the z-direction, the lamination direction of the coil component 1, is in parallel to the mounting surface of the circuit board 80.

The circuit board 80 has land patterns 81 and 82, which are connected with the external terminals E1 and E2 of the coil component 1, respectively. The electrical/mechanical connection between the land patterns 81, 82 and external terminals E1, E2 is achieved by solder 83. A fillet of the solder 83 is formed on a part of the external terminal E1 (E2) that is formed on the surface S5 (S6). The external terminals E1 and E2 are each constituted of a laminated film of nickel (Ni) and tin (Sn), whereby wettability of the solder is enhanced.

Figure 3:
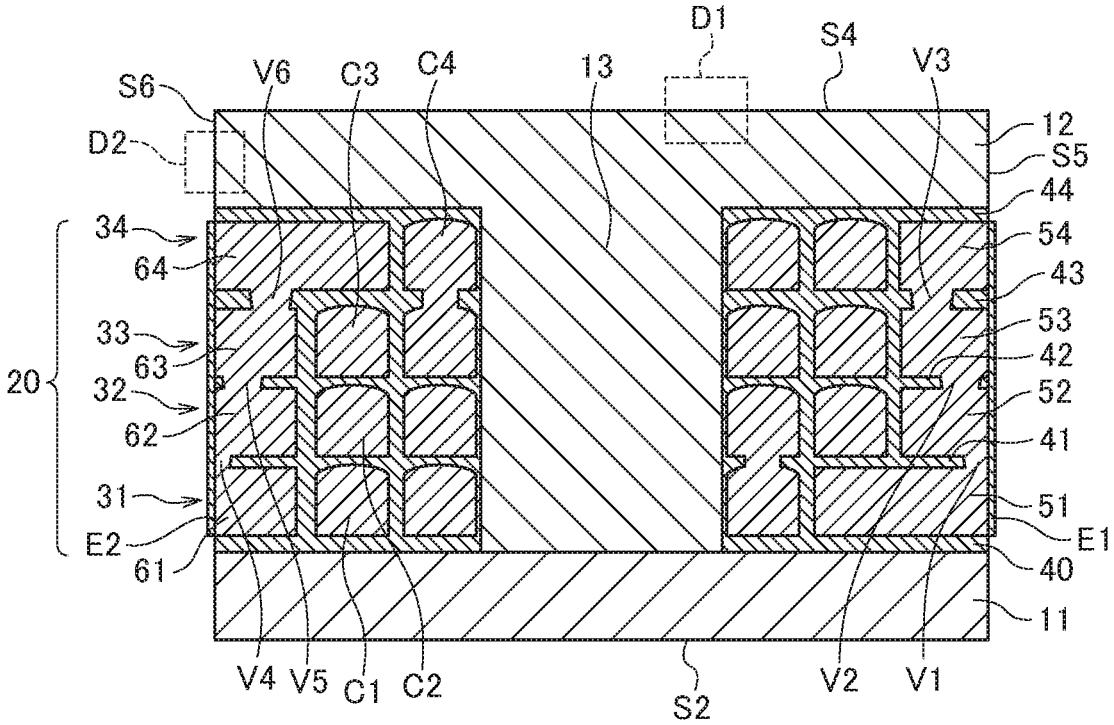
FIG. 3 is a cross-sectional view of the coil component 1 according to an embodiment of the present invention.

FIG. 3 is a cross-sectional view of the coil component 1 according to the present embodiment.

As illustrated in FIG. 3, the coil part 20 included in the coil component 1 is sandwiched between the two magnetic material layers 11 and 12 and has a configuration in which interlayer insulating layers 40 to 44 and conductive layers 31 to 34 are alternately laminated. The conductive layers 31 to 34 are connected to one another through holes formed in the interlayer insulating layers 41 to 43, respectively to thereby form a coil. As the material of the conductive layers 31 to 34, copper (Cu) is preferably used. A magnetic member 13 made of the same material as the magnetic material layer 12 is embedded in the inner diameter part of the coil. The magnetic member 13 also constitutes a part of the magnetic element body 10 together with the magnetic material layers 11 and 12. The interlayer insulating layers 40 to 44 are each made of, e.g., resin, and a non-magnetic material is used for at least the interlayer insulating layers 41 to 43. A magnetic material may be used for the lowermost interlayer insulating layer 40 and the uppermost interlayer insulating layer 44.

The conductive layer 31 is the first conductive layer formed on the upper surface of the magnetic material layer through the interlayer insulating layer 40. The conductive layer 31 has a coil conductive pattern C1 spirally wound in two turns and two electrode patterns 51 and 61. The electrode pattern 51 is connected to one end of the coil conductive pattern C1, while the electrode pattern 61 is formed independently of the coil conductive pattern C1. The electrode pattern 51 is exposed from the coil part 20, and the external terminal E1 is formed on the exposed surface of the electrode pattern 51. The electrode pattern 61 is exposed from the coil part 20, and the external terminal E2 is formed on the exposed surface of the electrode pattern 61.

The conductive layer 32 is the second conductive layer formed on the upper surface of the conductive layer through the interlayer insulating layer 41. The conductive layer 32 has a coil conductive pattern C2 spirally wound in two turns and two electrode patterns 52 and 62. The electrode patterns 52 and 62 are both formed independently of the coil conductive pattern C2. The electrode pattern 52 is exposed from the coil part 20, and the external terminal E1 is formed on the exposed surface of the electrode pattern 52. The electrode pattern 62 is exposed from the coil part 20, and the external terminal E2 is formed on the exposed surface of the electrode pattern 62.

The conductive layer 33 is the third conductive layer formed on the upper surface of the conductive layer 32 through the interlayer insulating layer 42. The conductive layer 33 has a coil conductive pattern C3 spirally wound in two turns and two electrode patterns 53 and 63. The electrode patterns 53 and 63 are both formed independently of the coil conductive pattern C3. The electrode pattern is exposed from the coil part 20, and the external terminal E1 is formed on the exposed surface of the electrode pattern 53. The electrode pattern 63 is exposed from the coil part 20, and the external terminal E2 is formed on the exposed surface of the electrode pattern 63.

The conductive layer 34 is the fourth conductive layer formed on the upper surface of the conductive layer through the interlayer insulating layer 43. The conductive layer 34 has a coil conductive pattern C4 spirally wound in two turns and two electrode patterns 54 and 64. The electrode pattern 64 is connected to one end of the coil conductive pattern C4, while the electrode pattern 54 is formed independently of the coil conductive pattern C4. The electrode pattern 54 is exposed from the coil part 20, and the external terminal E1 is formed on the exposed surface of the electrode pattern 54. The electrode pattern 64 is exposed from the coil part 20, and the external terminal E2 is formed on the exposed surface of the electrode pattern 64.

The coil conductive pattern C1 and the coil conductive pattern C2 are connected to each other through a via conductor formed penetrating the interlayer insulating layer 41, the coil conductive pattern C2 and the coil conductive pattern C3 are connected to each other through a via conductor formed penetrating the interlayer insulating layer 42, and the coil conductive pattern C3 and the coil conductive pattern C4 are connected to each other through a via conductor formed penetrating the interlayer insulating layer 43. As a result, a coil of eight turns is formed by the coil conductive patterns C1 to C4, and one and the other ends thereof are connected respectively to the external terminals E1 and E2.

Further, the electrode patterns 51 to 54 are connected to one another through via conductors V1 to V3 formed penetrating the interlayer insulating layers 41 to 43. Similarly, the electrode patterns 61 to 64 are connected to one another through via conductors V4 to V6 formed penetrating the interlayer insulating layers 41 to 43. Although not especially limited, the formation positions of the respective via conductors V1 to V3 as viewed in the lamination direction differ from one another and, similarly, the formation positions of the respective via conductors V4 to V6 as viewed in the lamination direction differ from one another.

The surfaces of the respective conductive layers 32 to 34 may be recessed at portions where the via conductors V1 to V6 are formed. However, since the formation positions of the via conductors V1 to V3 as viewed in the lamination direction are offset from one another, and the formation positions of the via conductors V4 to V6 as viewed in the lamination direction are offset from one another, the recesses formed in the surfaces of the respective conductive layers 32 to 34 are not accumulated. Thus, a high degree of flatness can be ensured.

Figure 4:
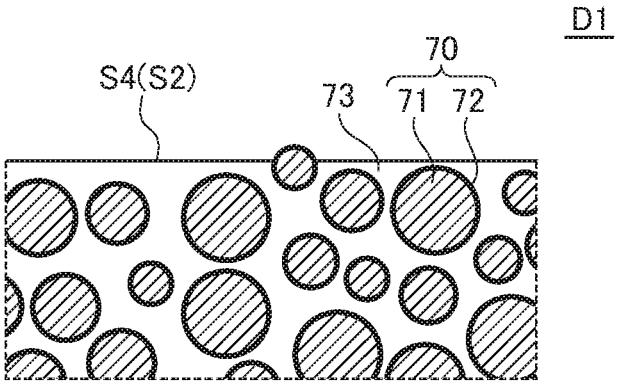
FIG. 4 is a schematic cross-sectional view illustrating in an enlarged manner an area D1 illustrated in FIG. 3.
Figure 5:
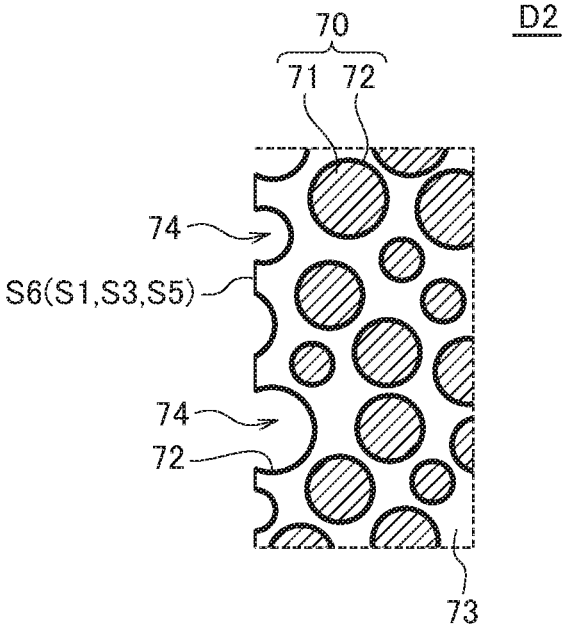
FIG. 5 is a schematic cross-sectional view illustrating in an enlarged manner an area D2 illustrated in FIG. 3.

FIG. 4 is a schematic cross-sectional view illustrating in an enlarged manner an area D1 illustrated in FIG. 3, and FIG. 5 is a schematic cross-sectional view illustrating in an enlarged manner an area D2 illustrated in FIG. 3. The area D1 refers to a cross section including the surface S4 of the magnetic element body 10, and an area including the surface S2 of the magnetic element body 10 has the same cross section as the area D1. The area D2 refers to a cross section including the surface S6 of the magnetic element body 10, and areas each including surfaces S1, S3, and S5 of the magnetic element body 10 have the same cross section as the D2.

As illustrated in FIGS. 4 and 5, the magnetic element body 10 is a composite material containing magnetic powder 70 as a filler and a resin material 73 such as epoxy resin as a binder. The magnetic powder 70 is constituted of a body part 71 of a metal magnetic material made of iron (Fe) or a permalloy-based material and an insulating coat 72 that covers the surface of the body part 71 and ensures the insulation property of the magnetic element body 10. The insulating coat 72 is, e.g., silica.

As illustrated in FIG. 4, the surface S4 (S2) of the magnetic element body 10 is substantially entirely composed of the resin material 73, and the body part 71 of the magnetic powder 70 is not exposed from the surface S4. The magnetic powder 70 may be partially exposed from the surface S4 (S2); however, even in such a case, the metal magnetic material constituting the body part 71 is not exposed from the surface S4 (S2) since the surface of the magnetic powder 70 is covered with the insulating coat 72.

On the other hand, as illustrated in FIG. 5, the surface S6 (S1, S3, S5) of the magnetic element body 10 has many recesses 74 formed as a result of removal of the body part 71 of the magnetic powder 70. Accordingly, the surface roughness of the surface S6 (S1, S3, S5) of the magnetic element body 10 is significantly larger than the surface roughness of the surface S4 (S2) of the magnetic element body 10. The surface roughness is determined by the particle diameter of the magnetic powder 70 as the filler. When the particle diameter of the magnetic powder is 10 μm to 60 μm, the surface roughness Ra of the surface S6 (S1, S3, S5) of the magnetic element body 10 is 5 μm to 50 μm. On the other hand, the surface S4 (S2) of the magnetic element body 10 has no recess 74, so that the surface roughness Ra is as small as 1 μm to 5 μm. The inner wall of the recess 74 is covered with the insulating coat 72.

Figure 6:
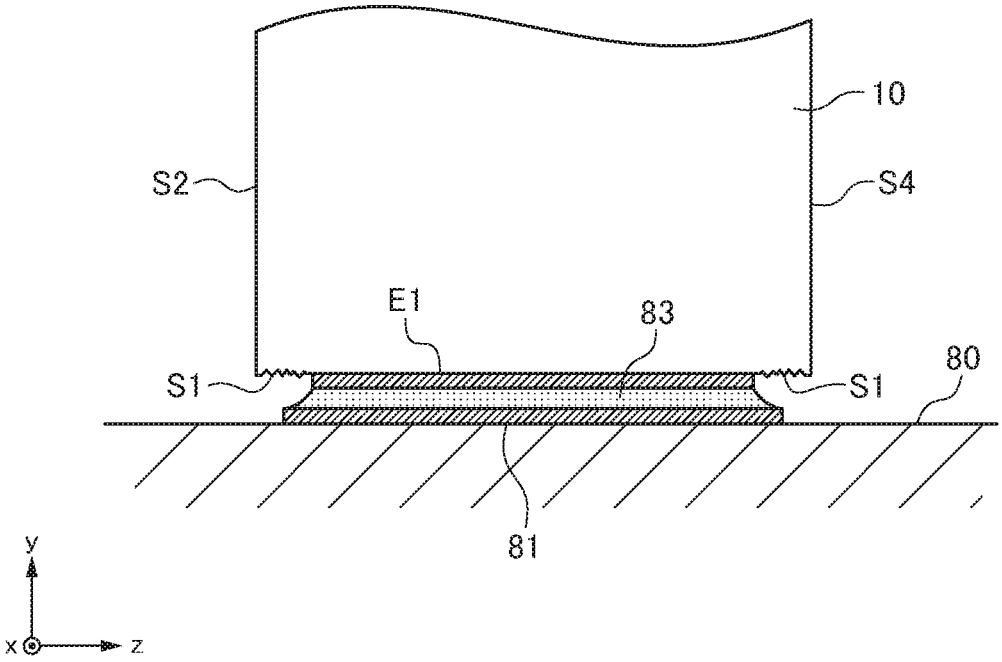
FIG. 6 is a schematic side view illustrating in an enlarged manner a portion around the external terminal of the coil component which is mounted on the circuit board.

FIG. 6 is a schematic side view illustrating in an enlarged manner a portion around the external terminal E1 of the coil component 1 which is mounted on the circuit board 80.

As described above, the surface S1 of the magnetic element body 10 on which the external terminal E1 is formed has an increased surface roughness due to the existence of the many recesses 74. Thus, as compared with the surface roughness being small like the surfaces S2 and S4, the creeping distance from the external terminal E1 to the surfaces S2 and S4 is increased, thus making it difficult for the solder 83 to sneak to the surfaces S2 and S4 along the surface S1. The surfaces S2 and S4 are surfaces vertical to the coil axis, so that when current is made to flow in the coil conductor, a large amount of magnetic flux is generated on the surface S2 and S4. Thus, when the solder 83 sneaks to the surfaces S2 and S4 of the magnetic element body 10, the magnetic flux is partially blocked by the solder 83, which may result in reduction in inductance. On the other hand, in the coil component 1 according to the present embodiment, the surface roughness of the surfaces S1, S5, and S6 on which the external terminal (E1, E2) is formed is made larger than the surface roughness of the surfaces S2 and S4, so that it is possible to prevent the solder 83 from sneaking to the surfaces S2 and S4 to thereby prevent reduction in inductance.

The following describes a manufacturing method for the coil component 1 according to the present embodiment.

FIGS. 7A to 7F and 8A to 8D are process views for explaining the manufacturing processes of the coil component 1 according to the present embodiment. FIGS. 9A to 9H are plan views for explaining a pattern shape in each process.

Figure 7A:
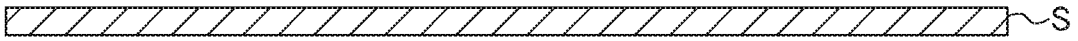
FIGS. 7A to 7F and 8A to 8D are process views for explaining the manufacturing processes of the coil component according to an embodiment of the present invention.
Figure 7B:
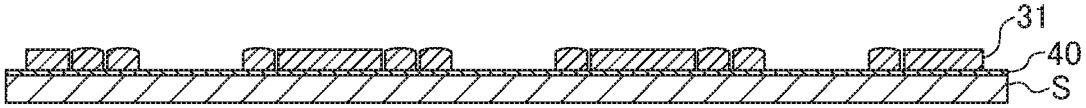

As illustrated in FIG. 7A, a support substrate S having a predetermined level of strength is prepared, and a resin material is applied on the upper surface of the support substrate S by a spin coating method to form the interlayer insulating layer 40. Then, as illustrated in FIG. 7B, the conductive layer 31 is formed on the upper surface of the interlayer insulating layer 40. Preferably, as the formation method for the conductive layer 31, a base metal film is formed using a thin-film formation process such as sputtering, and then copper (Cu) is grown by plating to a desired film thickness using an electroplating method. The conductive layers 32 to 34 to be formed subsequently are formed in the same manner.

Figures 9E, 9F, 9G, 9H:
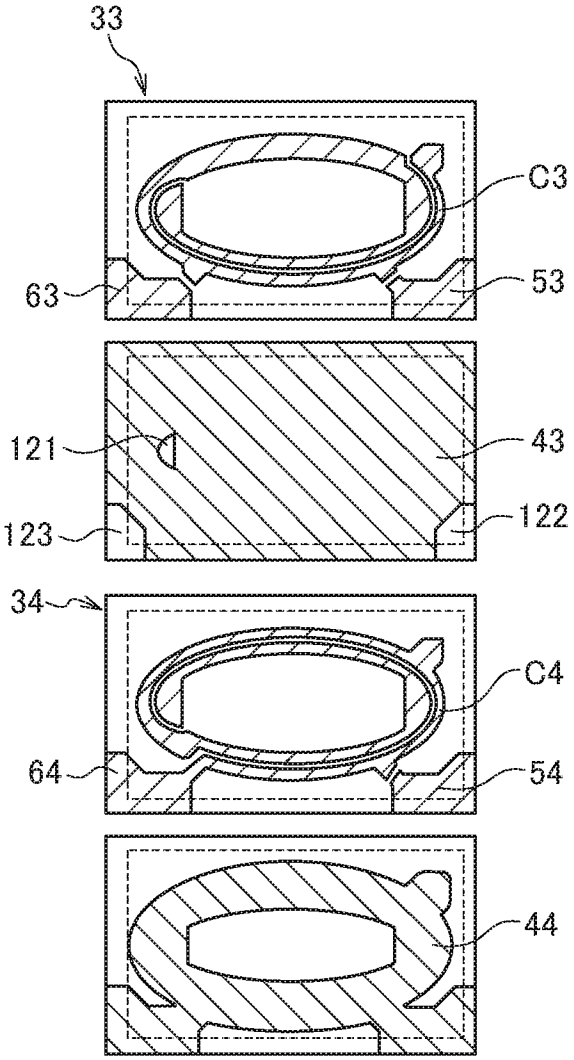
FIGS. 9A to 9H are plan views for explaining a pattern shape in each process.
Figures 9A, 9B, 9C, 9D:
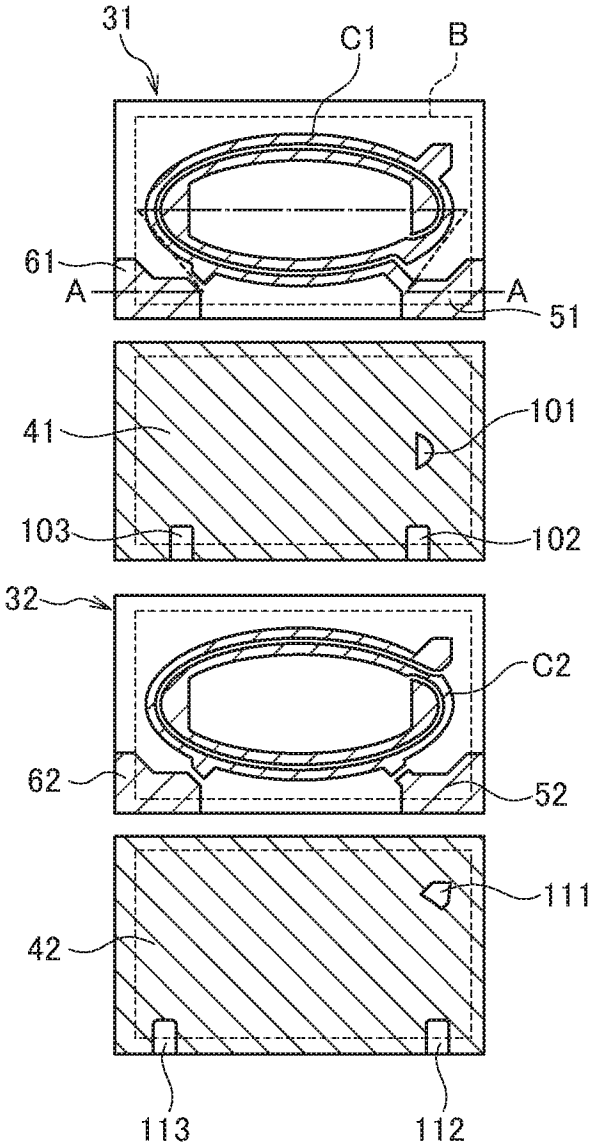

The conductive layer 31 has a planar shape as illustrated in FIG. 9A and includes the coil conductive pattern C1 spirally wound in two turns and two electrode patterns 51 and 61. The line A-A illustrated in FIG. 9A denotes the cross section position of FIG. 3, and the reference symbol B denotes the final product area of the coil component 1.

Then, as illustrated in FIG. 9B, the interlayer insulating layer 41 that covers the conductive layer 31 is formed. Preferably, in the formation of the interlayer insulating layer 41, a resin material is applied by a spin coating method, and then patterning is performed by photolithography. The interlayer insulating layers 42 to 44 to be formed subsequently are formed in the same manner. The interlayer insulating layer 41 has through holes 101 to 103 through which the conductive layer 31 is exposed. The through hole 101 is formed at a position through which the inner peripheral end of the coil conductive pattern C1 is exposed, the through hole 102 is formed at a position through which the electrode pattern 51 is exposed, and the through hole 103 is formed at a position through which the electrode pattern 61 is exposed.

Figure 7C:
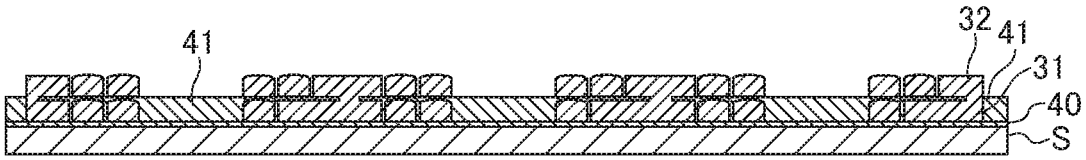

Then, as illustrated in FIG. 7C, the conductive layer is formed on the upper surface of the interlayer insulating layer 41. The conductive layer 32 has a planar shape as illustrated in FIG. 9C and includes the coil conductive pattern C2 spirally wound in two turns and two electrode patterns 52 and 62. As a result, the inner peripheral end of the coil conductive pattern C2 is connected to the inner peripheral end of the coil conductive pattern C1 through the through hole 101. The electrode pattern 52 is connected to the electrode pattern 51 through the through hole 102, and the electrode pattern 62 is connected to the electrode pattern 61 through the through hole 103. A part of the electrode pattern 52 that is embedded in the through hole 102 constitutes the via conductor V1, and a part of the electrode pattern 62 that is embedded in the through hole 103 constitutes the via conductor V4.

Then, as illustrated in FIG. 9D, the interlayer insulating layer 42 that covers the conductive layer 32 is formed. The interlayer insulating layer 42 has through holes 111 to 113 through which the conductive layer 32 is exposed. The through hole 111 is formed at a position through which the outer peripheral end of the coil conductive pattern C2 is exposed, the through hole 112 is formed at a position through which the electrode pattern 52 is exposed, and the through hole 113 is formed at a position through which the electrode pattern 62 is exposed. As is clear from comparison between FIG. 9B and FIG. 9D, the formation position of the through hole 112 is offset from the formation position of the through hole 102, and the formation position of the through hole 113 is offset from the formation position of the through hole 103.

Figure 7D:
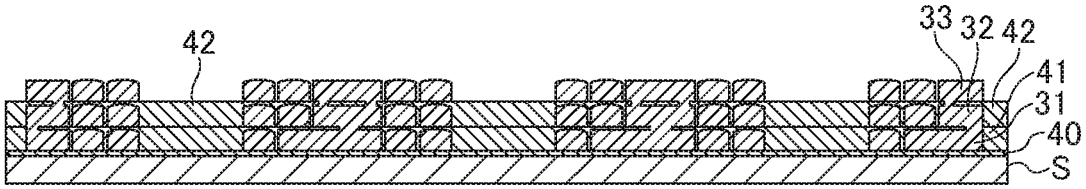

Then, as illustrated in FIG. 7D, the conductive layer is formed on the upper surface of the interlayer insulating layer 42. The conductive layer 33 has a planar shape as illustrated in FIG. 9E and includes the coil conductive pattern C3 spirally wound in two turns and two electrode patterns 53 and 63. As a result, the outer peripheral end of the coil conductive pattern C3 is connected to the outer peripheral end of the coil conductive pattern C2 through the through hole 111. The electrode pattern 53 is connected to the electrode pattern 52 through the through hole 112, and the electrode pattern 63 is connected to the electrode pattern 62 through the through hole 113. A part of the electrode pattern 53 that is embedded in the through hole 112 constitutes the via conductor V2, and a part of the electrode pattern 63 that is embedded in the through hole 113 constitutes the via conductor V5. The via conductor V2 is formed at a position offset from the via conductor V1, and the via conductor V5 is formed at a position offset from the via conductor V4.

Then, as illustrated in FIG. 9F, the interlayer insulating layer 43 that covers the conductive layer 33 is formed. The interlayer insulating layer 43 has through holes 121 to 123 through which the conductive layer 33 is exposed. The through hole 121 is formed at a position through which the inner peripheral end of the coil conductive pattern C3 is exposed, the through hole 122 is formed at a position through which the electrode pattern 53 is exposed, and the through hole 123 is formed at a position through which the electrode pattern 63 is exposed. As is clear from comparison among FIG. 9B, FIG. 9D, and FIG. 9F, the formation position of the through hole 122 is offset from the formation positions of the through holes 102 and 112, and the formation position of the through hole 123 is offset from the formation positions of the through holes 103 and 113.

Figure 7E:
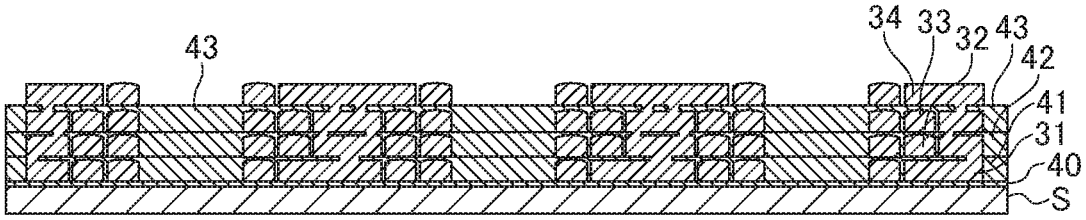

Then, as illustrated in FIG. 7E, the conductive layer is formed on the upper surface of the interlayer insulating layer 43. The conductive layer 34 has a planar shape as illustrated in FIG. 9G and includes the coil conductive pattern C4 spirally wound in two turns and two electrode patterns 54 and 64. As a result, the inner peripheral end of the coil conductive pattern C4 is connected to the inner peripheral end of the coil conductive pattern C3 through the through hole 121. The electrode pattern 54 is connected to the electrode pattern 53 through the through hole 122, and the electrode pattern 64 is connected to the electrode pattern 63 through the through hole 123. A part of the electrode pattern 54 that is embedded in the through hole 122 constitutes the via conductor V3, and a part of the electrode pattern 64 that is embedded in the through hole 123 constitutes the via conductor V6. The via conductor V3 is formed at a position offset from the via conductors V1 and V2, and the via conductor V6 is formed at a position offset from the via conductors V4 and V5.

Figure 7F:
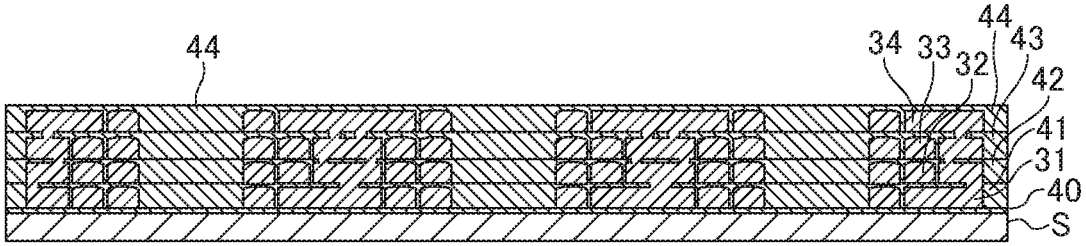

Then, as illustrated in FIG. 7F, the interlayer insulating layer 44 that covers the conductive layer 34 is formed on the entire surface and is then patterned as illustrated in FIG. 9H. Specifically, the patterning is performed such that the coil conductive pattern C4 and electrode patterns 54 and 64 are covered by the interlayer insulating layer 44 and that the remaining area is exposed.

Figure 8A:
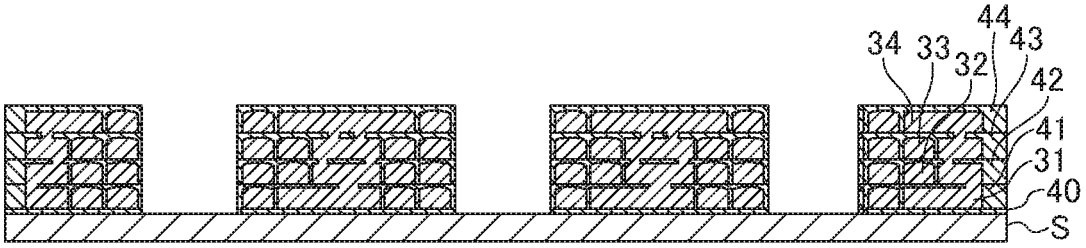

Then, as illustrated in FIG. 8A, dry etching is performed using the patterned interlayer insulating layer 44 as a mask. As a result, a part of each of the interlayer insulating layers 40 to 43 that is not covered by the mask is removed, and a space is formed in the inner diameter area surrounded by the coil conductive patterns C1 to C4 and the coil external area positioned outside the coil conductive patterns C1 to C4.

Figure 8B:
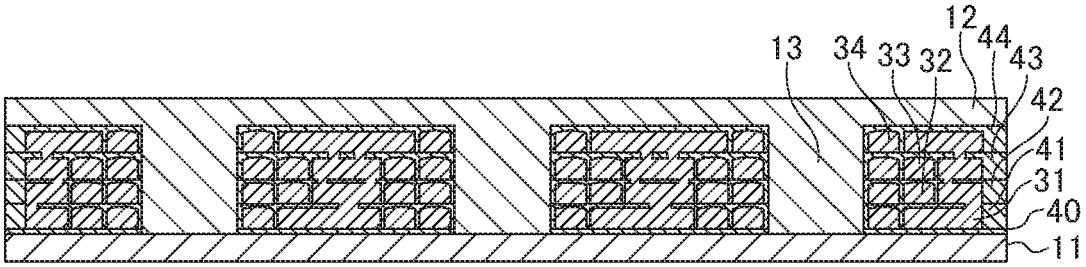

Then, as illustrated in FIG. 8B, a resin composite material containing the magnetic powder 70 is embedded in the space formed by the removal of the interlayer insulating layers 40 to 43. As a result, the magnetic material layer 12 is formed above the coil conductive patterns C1 to C4, and the magnetic member 13 is formed in the inner diameter area surrounded by the coil conductive patterns C1 to C4 and the coil external area positioned outside the coil conductive patterns C1 to C4. After that, the support substrate S is peeled off, and the composite member is also formed on the lower surface side of the coil conductive patterns C1 to C4 to form the magnetic material layer 11.

Figure 8C:
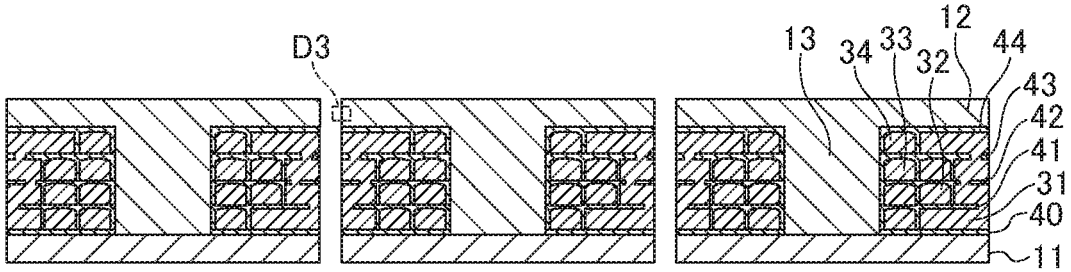
Figure 10:
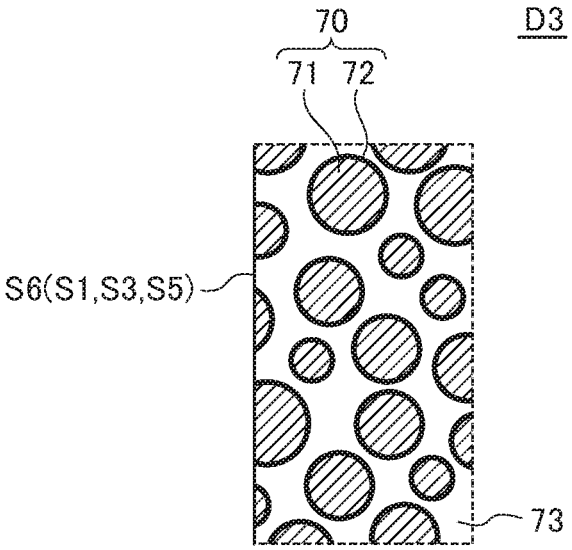
FIG. 10 is a schematic cross-sectional view illustrating in an enlarged manner an area D3 illustrated in FIG. 8C.

Then, as illustrated in FIG. 8C, dicing is performed for chip individualization. As a result, the electrode patterns 51 to 54 and 61 to 64 are partially exposed from the dicing surface. Further, as illustrated in FIG. 10 which is an enlarged view of the area D3 of FIG. 8C, the cross section of the cut magnetic powder 70, i.e., the body part 71 of the metal magnetic material is exposed from the dicing surface of the magnetic element body 10. The dicing surface of the magnetic element body 10 refers to the surfaces S1, S3, S5, and S6. On the other hand, the surfaces S2 and S4 are not the dicing surface, and thus their surface conditions illustrated in FIG. 4 are kept. That is, the cross section of the cut magnetic powder 70 is not exposed from the surfaces S2 and S4 of the magnetic element body 10.

Then, the body part 71 of the magnetic powder 70 exposed from the dicing surface of the magnetic element body 10 is etched by acid. While there is no particular restriction on the type of acid to be used, an etchant having a higher etching rate for a material (iron or permalloy) constituting the body part 71 of the magnetic powder 70 than for copper (Cu) constituting the electrode patterns 51 to 54 and 61 to 64 is preferably used. This makes it possible to remove the body part 71 of the cut magnetic powder 70 while suppressing damage to the electrode patterns 51 to 54 and 61 to 64 exposed from the dicing surface of the magnetic element body 10.

After removal of the body part 71 of the cut magnetic powder 70, the surfaces S1, S3, S5, and S6 each of which is the dicing surface have many recesses 74 as illustrated in FIG. 5. At this time, the etchant contacts also the surfaces S2 and S4 of the magnetic element body 10; however, since the cross section of the cut magnetic powder 70 is not exposed from the surfaces S2 and S4 of the magnetic element body 10, etching is not performed. Although there may be a case where the magnetic powder 70 is partially exposed from the surfaces S2 and S4 of the magnetic element body 10, the surface of the magnetic powder 70 is covered with the insulating coat 72, preventing the body part 71 from being etched. Thus, even when the above-described etching is performed, the surface roughness of each of the surfaces S2 and S4 of the magnetic element body 10 does not substantially change.

Figure 8D:
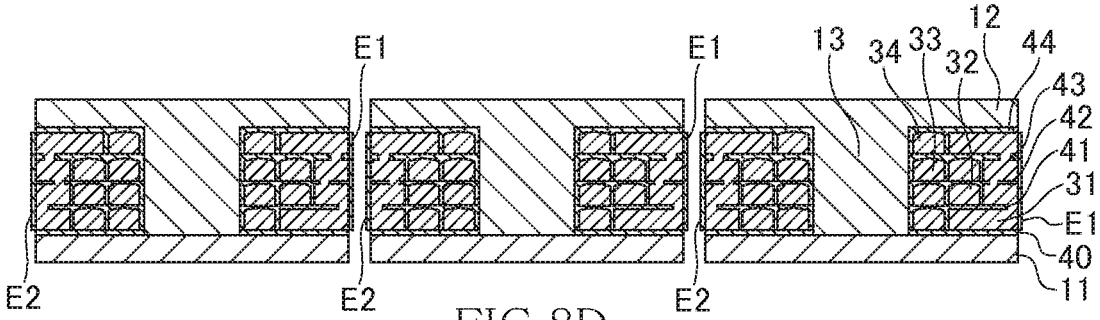

When barrel plating is performed in this state, the external terminals E1 and E2 are formed on the exposed surface of the electrode patterns 51 to 54 and the exposed surface of the electrode patterns 61 to 64, respectively, as illustrated in FIG. 8D. At this time point, the magnetic powder 70 exposed from the dicing surface of the magnetic element body 10 has already been removed, so that no plating is formed on the magnetic powder 70 contained in the magnetic element body 10.

Thus, the coil component 1 according to the present embodiment is completed.

As described above, in the present embodiment, after the coil component 1 is diced into individual semiconductor chips, the body part 71 of the magnetic powder 70 exposed from the dicing surface is removed by etching, so that it is possible to make the surface roughness of each of the surfaces S1, S3, S5, and S6 each of which is the dicing surface larger than the surface roughness of each of the surfaces S2 and S4 each of which is a non-dicing surface. Thus, as described above, the creeping distance of each of the surfaces S1, S5, and S6 of the magnetic element body 10 is increased, thus making it hard for the solder 83 to sneak to the surfaces S2 and S4 along the surfaces S1, S5, and S6.

Figure 11:
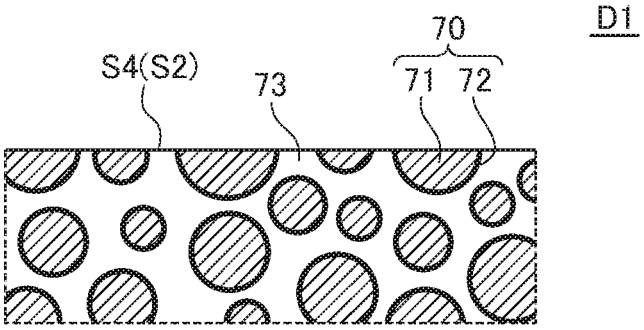
FIG. 11 is a schematic cross-sectional view illustrating in an enlarged manner an area D1 according to a first modification.
Figure 12:
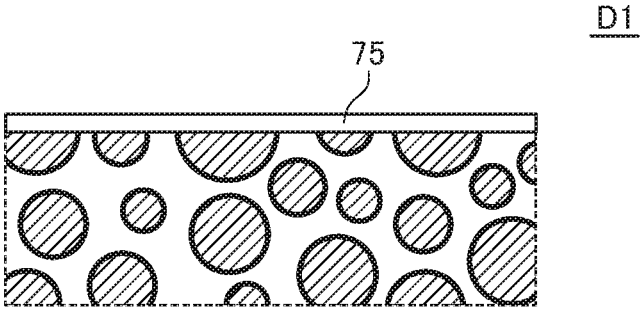
FIG. 12 is a schematic cross-sectional view illustrating in an enlarged manner an area D1 according to a second modification.

In the above embodiment, surface treatment such as polishing or grinding is not applied to the surfaces S2 and S4 of the magnetic element body 10. However, the surfaces S2 and S4 may be subjected to polishing or grinding for adjustment of the thickness of the coil component 1. In this case, as illustrated in FIG. 11, the cross section of the cut magnetic powder 70 is exposed from the surfaces S2 and S4 of the magnetic element body 10. Assume here that the surfaces S2 and S4 are subjected to polishing or grinding before chip individualization. In this case, when etching is applied to the entire surface of the magnetic element body 10, the body part 71 of the magnetic powder 70 exposed from the surfaces S2 and S4 is inevitably etched, resulting in reduction in inductance. To prevent this, etching is applied with the surfaces S2 and S4 of the magnetic element body 10 masked. Alternatively, as illustrated in FIG. 12, an insulating coat 75 may be applied after polishing or grinding of the surfaces S2 and S4 to cover the surfaces S2 and S4 so as to prevent the body part 71 on the surfaces S2 and S4 from being etched. In this case, such an effect can also be obtained that dropping of the magnetic powder 70 during actual use is avoided.

It is apparent that the present invention is not limited to the above embodiments, but may be modified and changed without departing from the scope and spirit of the invention.

For example, although the coil part 20 includes four conductive layers 31 to 34 in the above embodiment, the number of conductive layers is not limited to this in the present invention. Further, the number of turns of the coil conductive pattern formed in each conductive layer is not particularly limited.

What is claimed is:

1. A coil component comprising:

a magnetic element body made of a composite material containing magnetic powder and a resin material, the magnetic powder including a body part made of a metal magnetic material and an insulating coat that covers a surface of the body part, the insulating coat being made of a different insulating material from the resin material, the magnetic element body having first and second surfaces;

a coil part conductor embedded in the magnetic element body, the coil part having a configuration in which a plurality of interlayer insulating layers and a plurality of coil conductive patterns are alternately laminated and an external terminal connected to a coil conductor constituted of the plurality of coil conductive patterns and exposed on the first surface of the magnetic element body without contacting the magnetic element body such that one of the plurality of interlayer insulating layers intervenes between the external terminal and the magnetic element body, wherein the second surface of the magnetic element body is free from the external terminal, and wherein the first surface is greater in surface roughness than the second surface, and wherein the first surface has a plurality of recesses, an inner wall of the recesses being coated by a same insulating material as the insulating coat of the magnetic powder.

2. The coil component as claimed in claim 1, wherein the magnetic element body has a substantially rectangular parallelepiped shape, wherein the first and second surfaces are substantially perpendicular to each other, wherein the magnetic element body further includes a third surface positioned on a side opposite to the first surface, a fourth surface positioned on a side opposite to the second surface, and fifth and sixth surfaces which are substantially perpendicular to the first to fourth surfaces and positioned on mutually opposite sides, wherein the external terminal includes a first external terminal connected to one end of the coil conductor and a second external terminal connected to other end of the coil conductor, wherein the first external terminal is exposed on the first and fifth surfaces without being exposed on the second, third, fourth, and sixth surfaces, and wherein the second external terminal is exposed on the first and sixth surfaces without being exposed on the second, third, fourth, and fifth surfaces.

3. The coil component as claimed in claim 2, wherein a dimension of each of the first and second terminal electrodes in a direction perpendicular to the second and fourth surfaces is smaller than a dimension of the magnetic element body in a same direction.

4. The coil component as claimed in claim 2, wherein a coil axis of the coil conductor is perpendicular to the second and fourth surfaces.

5. The coil component as claimed in claim 1, wherein the coil conductor is made of copper (Cu), and the external terminal contains nickel (Ni) and tin (Su).

6. The coil component as claimed in claim 1, wherein the magnetic powder is exposed on the second surface, and wherein the body part of the magnetic powder exposed on the second surface is covered with the insulating coat so as not to expose the body part on the second surface.

7. The coil component as claimed in claim 1, wherein the body part of the magnetic powder is not exposed on the first surface.

8. The coil component as claimed in claim 1, wherein the insulating coat comprises an inorganic material.

9. The coil component as claimed in claim 1, further comprising another insulating coat that entirely covers the second surface of the of the magnetic element body without covering the first surface of the of the magnetic element body.

10. The coil component as claimed in claim 9, wherein the another insulating coat contacts the body part of the magnetic powder.

* * * * *